US006896015B2

(12) United States Patent
Beveridge

(10) Patent No.: US 6,896,015 B2
(45) Date of Patent: May 24, 2005

(54) BAG HOLDER TO FACILITATE FILLING

(76) Inventor: Benjamin Beveridge, 18 North Row, Warminster (GB), BA12 9AD ( * ) Notice: Subject to any disclaimer, the term of this patent is extended or adjusted under 35 U.S.C. 154(b) by 0 days.

(21) Appl. No.: 10/666,014

(22) Filed: Sep. 22, 2003

(65) Prior Publication Data

US 2004/0104317 A1 Jun. 3, 2004

(30) Foreign Application Priority Data

Oct. 10, 2003 (GB) ..... 0323725

(51) Int. Cl.[7] ..... B65B 1/04
(52) U.S. Cl. ..... 141/314; 141/391
(58) Field of Search ..... 141/10, 114, 313–319, 141/391; 248/97–101

(56) References Cited

U.S. PATENT DOCUMENTS 798,019 A * 8/1905 Deuel ..... 141/75
1,862,413 A * 6/1932 Malicay ..... 248/98
6,047,748 A * 4/2000 Rooker ..... 141/391

* cited by examiner

*Primary Examiner*—Steven O. Douglas

(57) ABSTRACT

A bag holding and filling device comprises a light strong portable framework to hold a sandbag, or similar flexible container. The bag to be filled is secured by means of four hooks two of which are arranged on swinging arms and two on the main framework. These hooks engage with the open neck of the sandbag and hold the top of the bag open. A conical shaped funnel with an included angle of approximately 80° is pivotally mounted on the framework so that the funnel is supported in a position such that any material fed into the funnel will be guided into the open neck of the bag. The funnel swings into another position in which access is available to the hooks to place or remove the bag. A spring or springs tension the bag hooks on the swinging arms so that the bag is securely held on the hooks during the filling operation. The bent tubular framework provides strength with lightness and is formed to facilitate hand carrying. The framework is supported on legs that are removable and the funnel is detachable and reattaches into the framework to create a simple and resilient reconstruction of the device with minimal use of space for storage and transport.

7 Claims, 7 Drawing Sheets

BAG HOLDER TO FACILITATE FILLING

BACKGROUND OF THE INVENTION

This invention relates to a portable framework designed to facilitate filling a flexible bag, sack or sandbag. A typical use could be for filling sandbags for flood control or protection from blast or ordnance where speed of manual filling could be of importance.

Currently, sandbags are usually filled by hand with one person holding the neck of the bag open while another person fills the bag with sand or other material using a spade or shovel. Due to the shape of the normal sandbag with a small cross section area relative to the length of the bag, it is difficult to fill the sandbag fast without considerable spillage. Various methods have been tried to improve the filling rate of the sandbags such as inverted cut-off traffic cones and simple funnels inserted into the top of the bags, but most of these systems still involve a team of two people to fill one sandbag This invention provides for a framework to hold a bag, sack or sandbag to allow a single operator to manually fill sandbags, or other flexible containers, in less time than a team of two operators working without the benefit of this invention. The structure enables simple regulation of the content of the bag to facilitate tying and to ensure the correct degree of fill for subsequent use For example sandbags for use in building flood defenses are required to be at most ⅔ full.

Transport or hand carrying of the framework is important in many flood situations. The invention provides a strong, light structure that is stable in use and can be readily dismantled and reassembled into a smaller format to enhance transport and storage. At the same time the framework includes a structural element that enables simple carrying of the whole.

INTRODUCTION TO THE DRAWINGS

A PREFERRED EMBODIMENT

Figure 1:
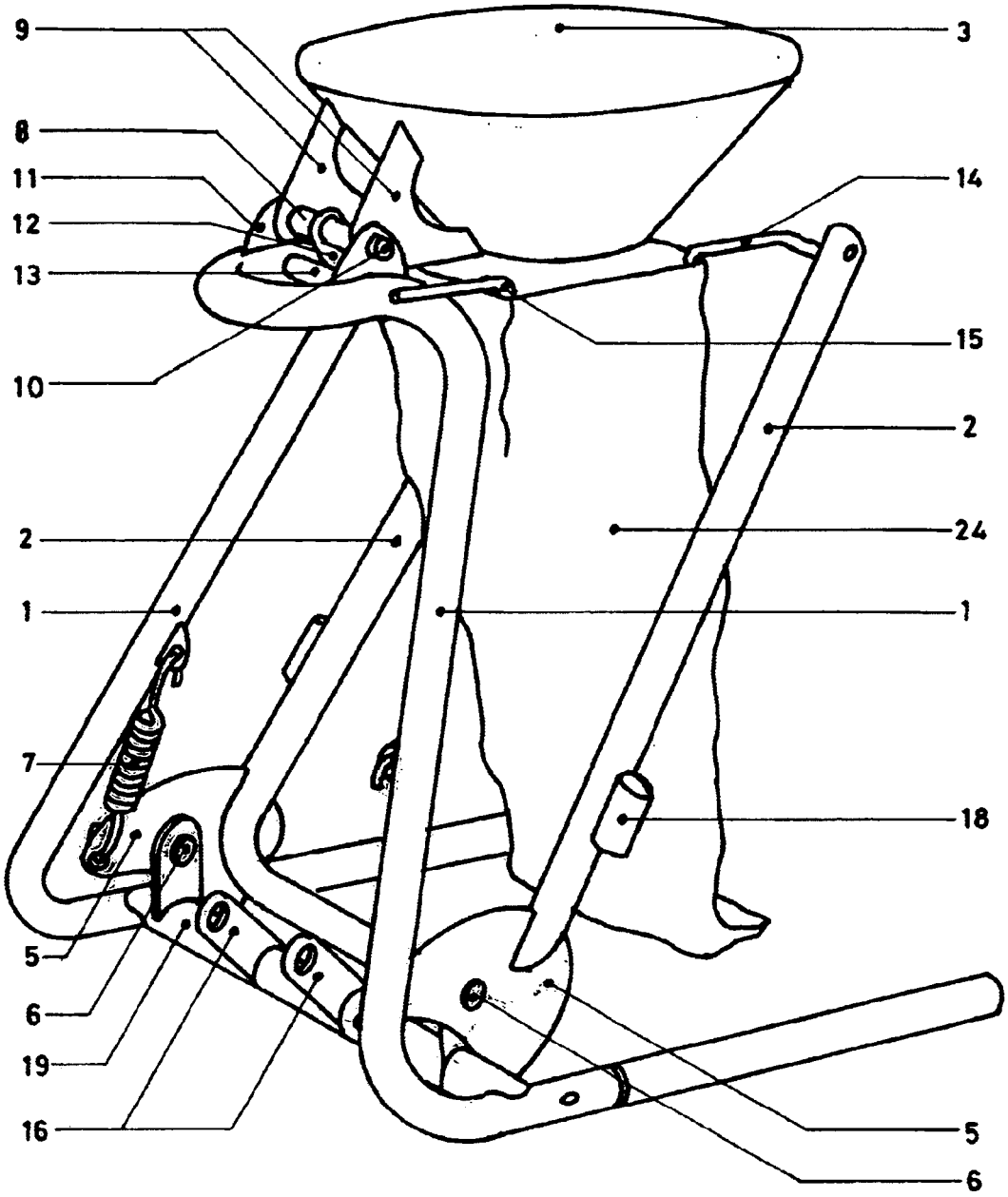
FIG. 1 shows a perspective view of the complete bag bolder without a bag installed.

Referring to the drawings, FIG. 1 shows the complete bag holder framework. The (in this case) tubular frame includes a rigid main framework (1) which includes a loop or bend (20) within this framework which supports the two fixed bag holding hooks (15) and the pivoting or hinging brackets (11) into which slides the pivoting tube (10) providing a hinged joint between the rigid main framework and the funnel (3).

The distance between the removable foot extensions (4) fitted into the locking mechanism (17) and the hooks (15) sets the height at which the bag (24) will be supported. A pair of swinging arms (2), bent from one piece of tubing, is connected with a base bracket (5) at either side. Each bracket (5) engages with a pivot pin (6) to provide a hinged connection with the rigid main framework. A hook (14) near the end of each arm aligns with the fixed hooks (15) mounted on the rigid main framework (1) such that the four hooks (14 & 15) can be engaged with the open top of a bag, sack or sandbag as will be described under FIGS. 3 & 4. The two swinging arms (2) are pulled away from the rigid main framework (1) so that anything connected between the fixed bag holding hooks (15) and the swinging arm bag holding hooks (14) is kept under tension by the action of springs (7) or similar means to pull the swinging arms (2) away from the rigid main framework (1). A conical funnel, (3) with, an included angle of 80° is mounted on the rigid main framework (1) by the brackets (9), pivot tube (8) and pivot pin (10) and hinging bracket (11), more clearly shown in FIG. 7. With the funnel folded down, the funnel (3) and the bag hooks (14 & 15) are located such that the bottom tapered exit of the funnel will discharge any material fed into the funnel into the open top of any bag, sack or sandbag (24) held by the bag hooks (14 & 15). The funnel is so mounted that it may be swung away from it's operating position above, the bag hooks to facilitate the installation and removal of any bag, sack or sandbag attached to the bag hooks.

Figure 2:
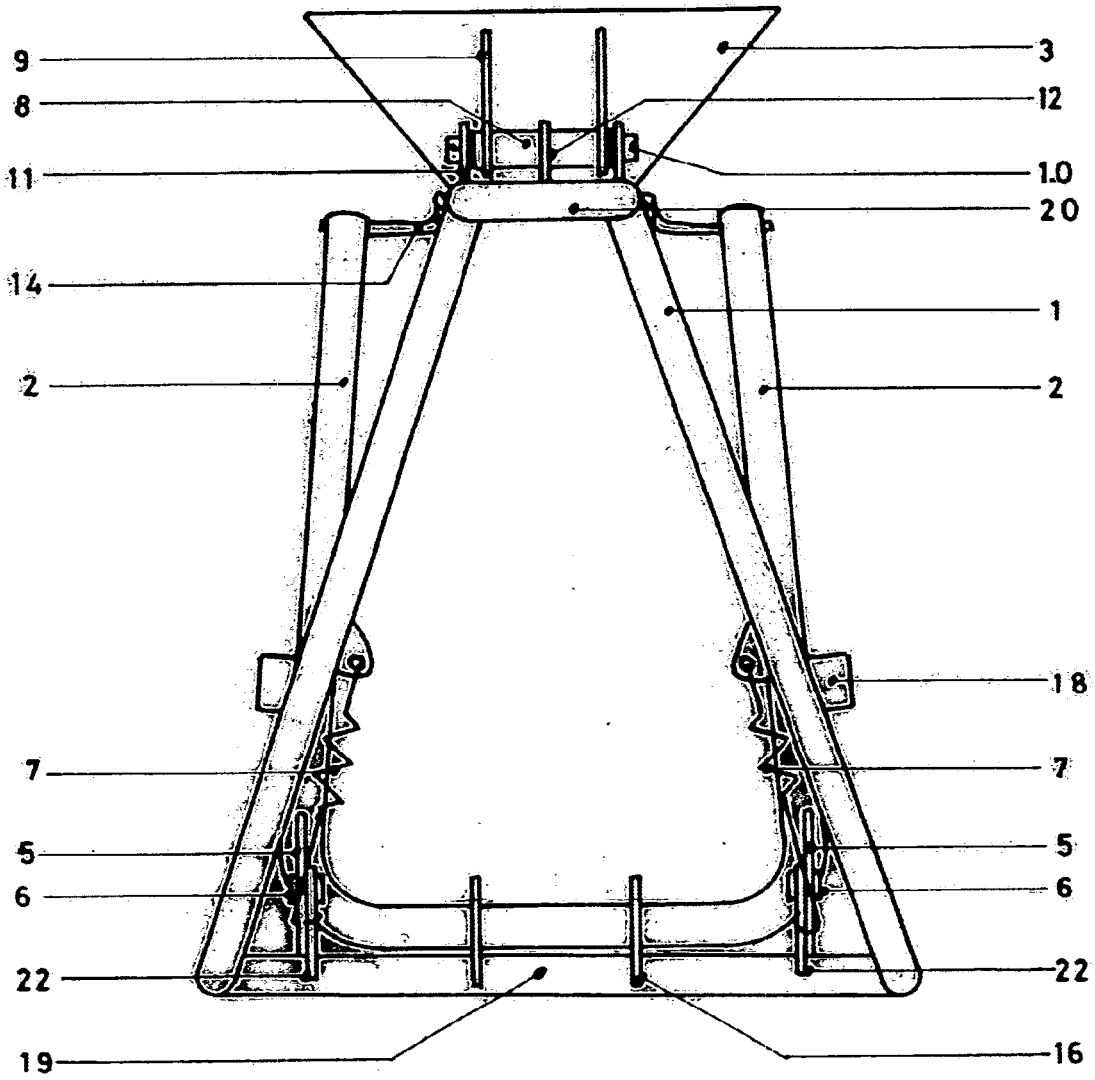
FIG. 2 shows a 'rear' view of the framework assembled ready to receive a bag.

FIG. 2 shows a 'rear' view of the bag holder assembled ready for use. Sleeves (18) are mounted on each of the swinging arms (2) to secure the removable foot extensions (4) shown in FIG. 1, for storage and transport. Similarly Mounting brackets (16) are provided on a cross member (19) in the rigid main framework to secure the funnel for storage transport.

Figure 3:
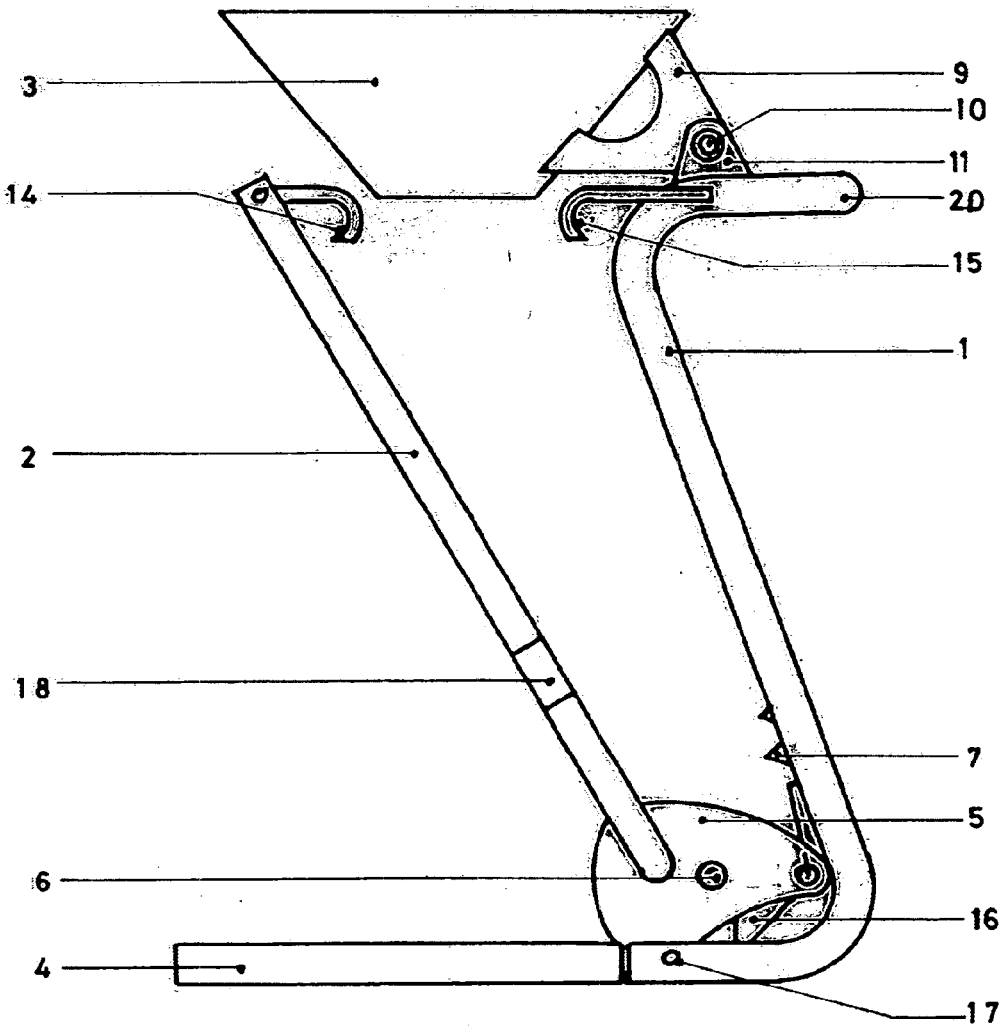
FIG. 3 shows a side view of the framework assembled ready to receive a bag.
Figure 8:
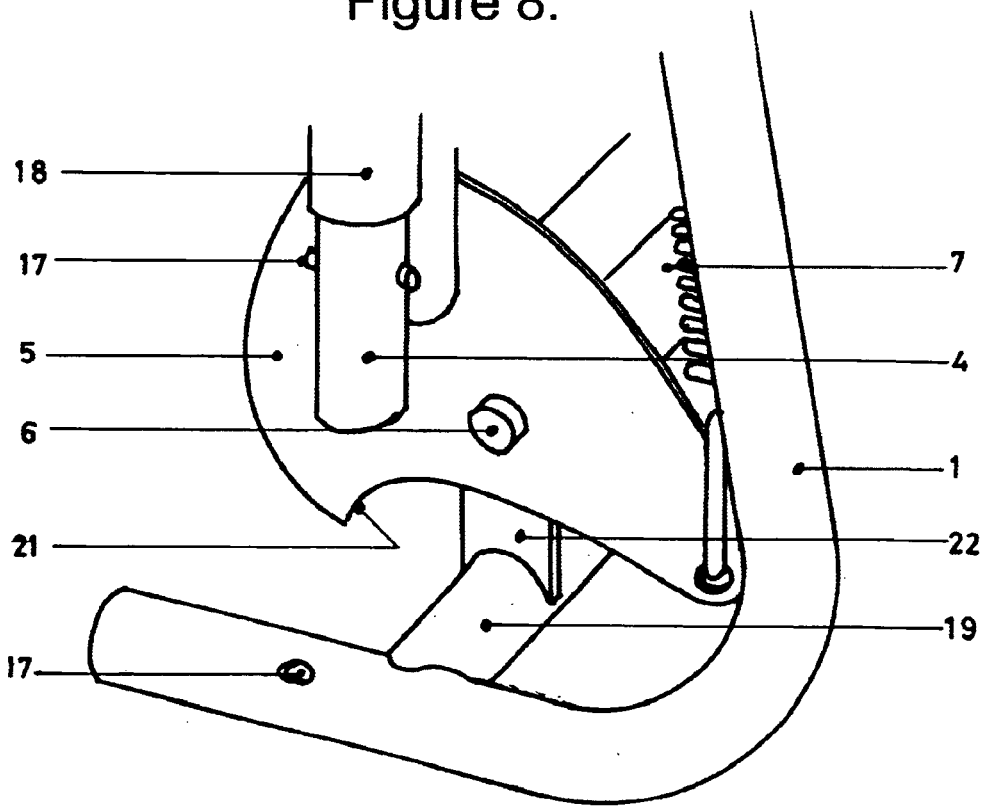
FIG. 8 shows details of the pivot connection between the framework and the swinging arms.

FIG. 3 shows a side view of the bag holder where the conical funnel (3) is positioned over the hooks (14 & 15) such that anything fed into the funnel will fall into the sandbag supported on the hooks. The bag hooks (14 & 15) are so positioned relative to the height of the bag, sack or sandbag to be used, that a proportion of the bag, sack or sandbagrests at the level of the bottom of the base (1) so that after the bag is filled to the to and disengaged from the bag hooks it is possible to manually lift the filled bag, sack or sandbag to allow the contents to drop into the unfilled bottom part of the bag to permit the now unfilled top portion of the bag, sack or sandbag to be gathered and tied or otherwise secured to prevent spillage of the contents. An object—such as a filled sandbag—may be placed between the support legs of the framework to decrease the volume of filling taken by the bag as required by the targeted use to which the filled bag will be applied. Bags for use in constructing flood control structures should;be only ⅔ full, while bags for blast diversion can be fuller. The swinging arms (2) are pulled away from the rigid main framework (1) by the action of the springs (7) but restrained by stops (21) as shown in FIGS. 6 & 8 incorporated in the swinging arm brackets (5) acting on the cross member (19) via brackets (22) and pivot pins (6) as shown in FIGS. 2 & 8, so that the swinging arm bag hooks are at a convenient position for an operator to engage one side of the top opening of a bag, sack or sandbag onto the hooks before forcing the opposite side of the bag against the pressure of the spring to engage onto the fixed bag hooks mounted on the rigid main framework thus securing the bag, sack or sandbag ready for filling through the funnel once the funnel has been lowered into the filling position as shown in FIG. 3.

Figure 4:
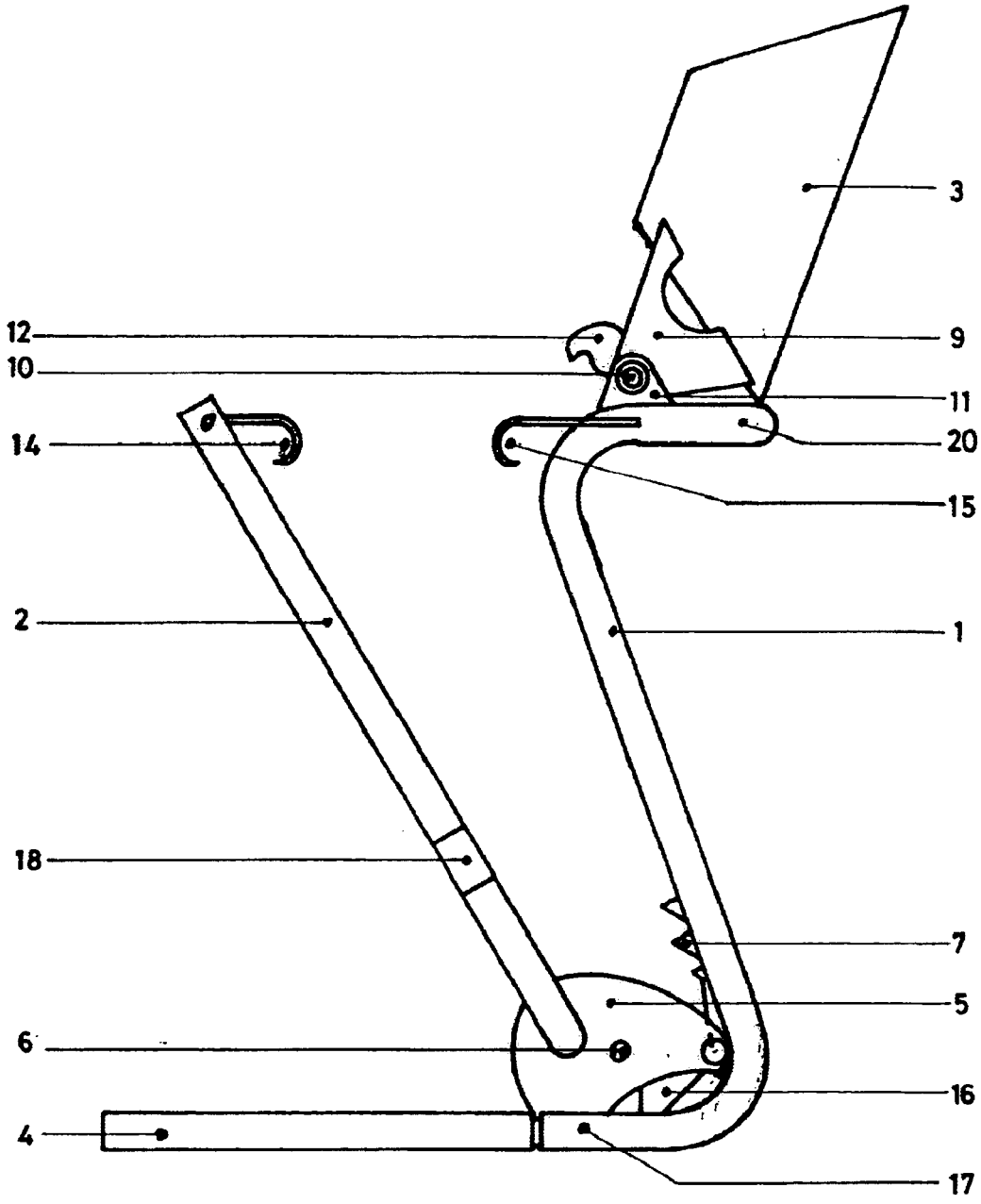
FIG. 4 shows a side view of the framework ready to receive a bag and with the funnel in the raised position. Providing convenient access to the hooks.

FIG. 4 shows a side view with the funnel (3) in the raised position to allow easy attachment or removal of the sandbag to or from the hooks (14 & 15). When the funnel is lowered for filling, the stop (12) engages with a cross bar (13) shown FIGS. 1 & 7, to retain the funnel in the optimum position for directing the filling material into the receptacle.

Figure 5:
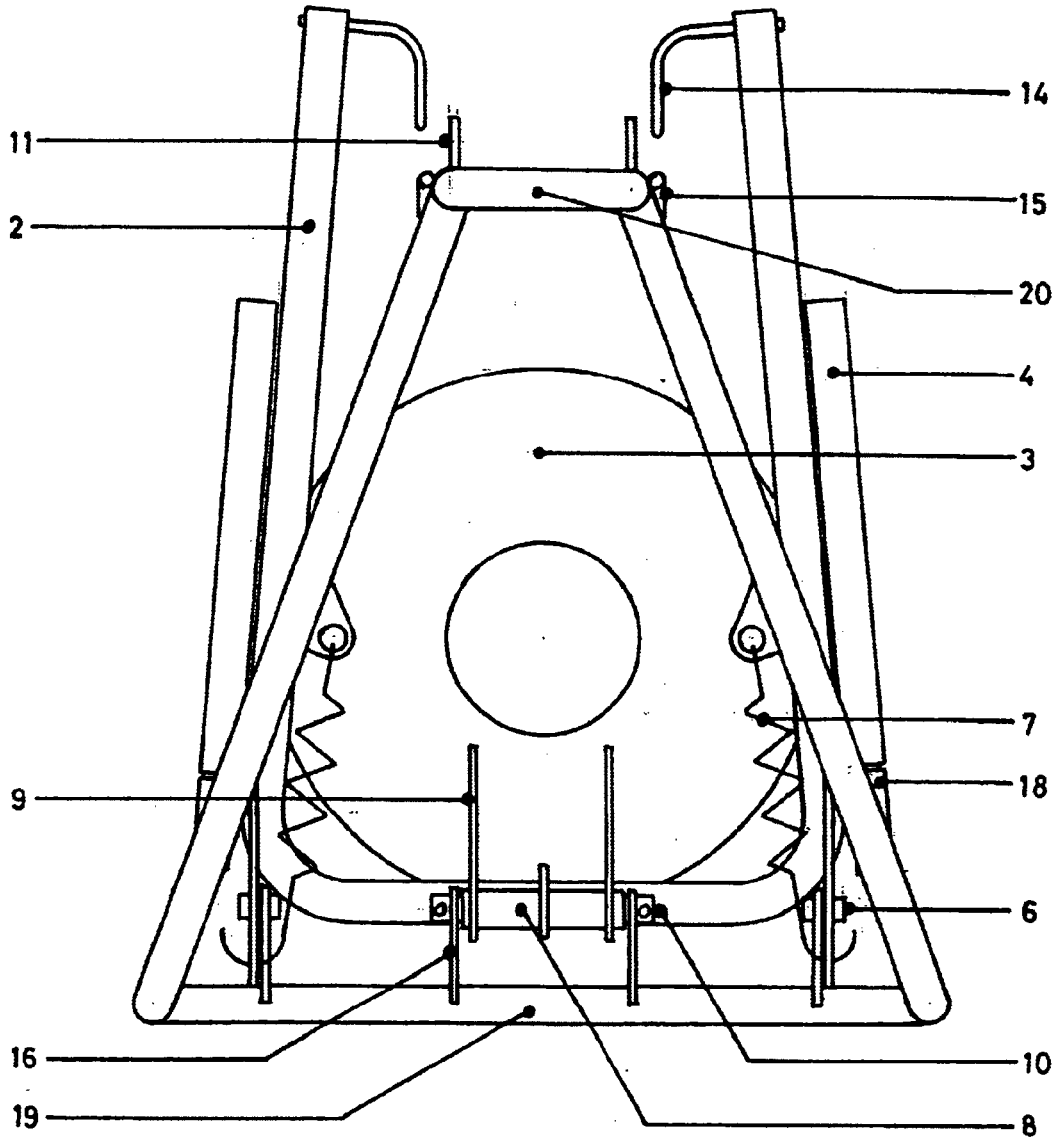
FIG. 5 shows the 'rear' view of the framework reassembled ready for packing and transport.
Figure 6:
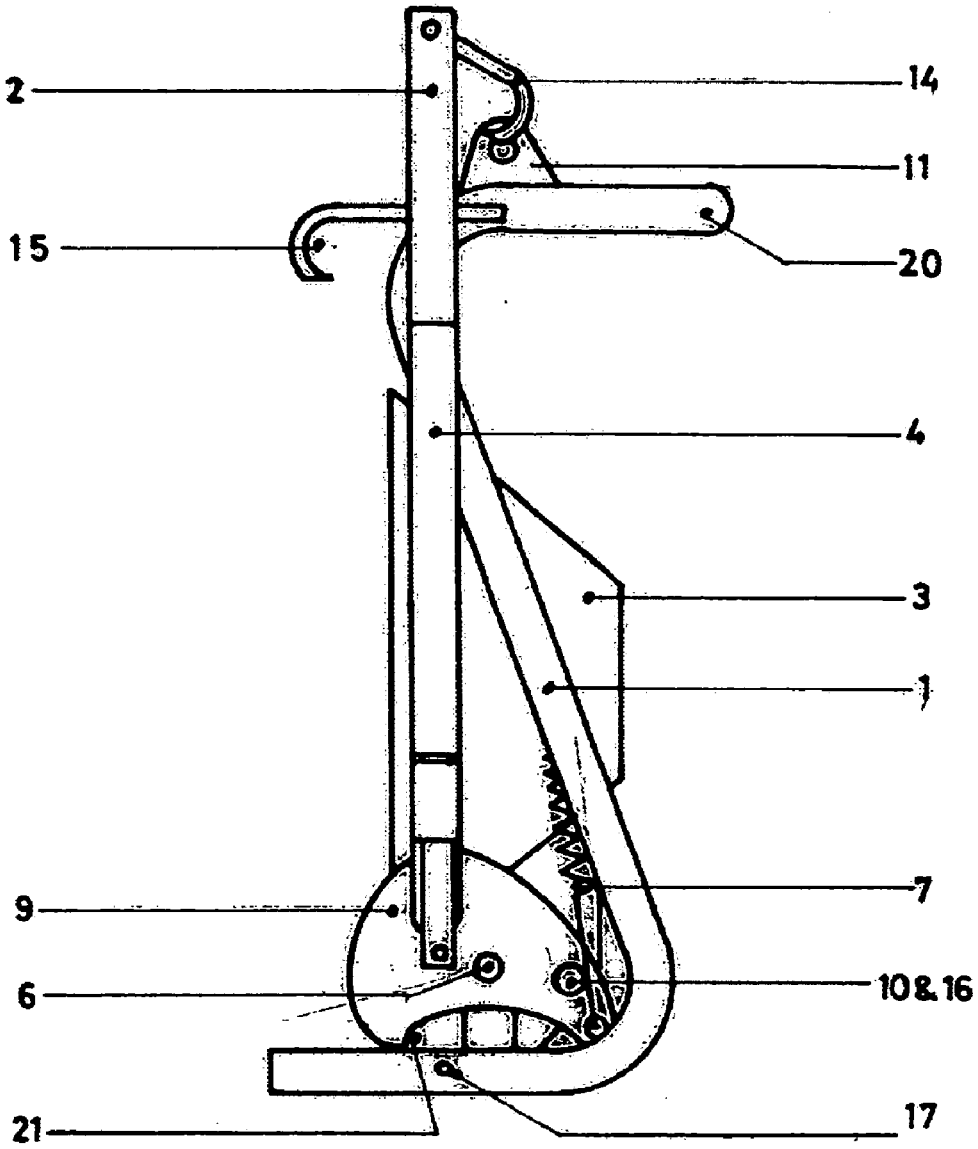
FIG. 6 shows a side view of the framework reassembled ready for packing and transport.

FIGS. 5 & 6 show the bag holder reassembled ready for transport and packing. The bend portion (20) of the rigid main framework provides a handle for ready carrying of the framework when reassembled for transport. The removable foot extensions (4) are inserted into the sleeves (18) on the swinging arms (2) and secured by locking mechanism (17) as shown in FIGS. 1 & 8. The pivot pin (10) is replaced into the funnel brackets pivot tube (8) engaged with the mounting brackets 16 positioned on the cross member (19) to locate the funnel and to restrain the swinging arms (2) against the force of the springs (7).

Figure 7:
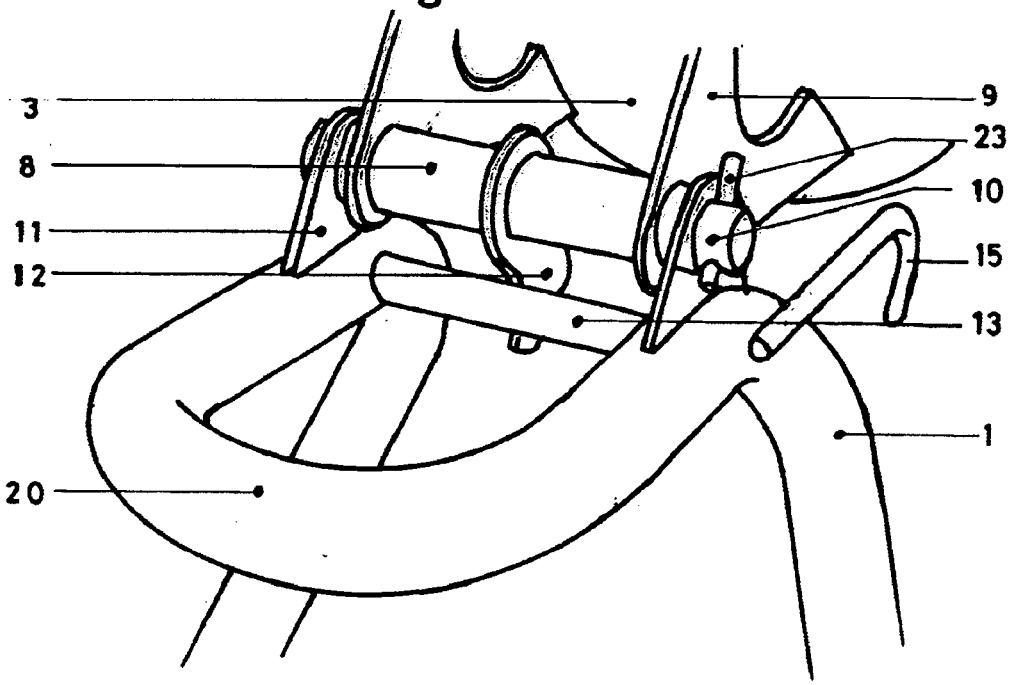
FIG. 7 shows details of the pivot connection between the funnel and framework.

FIG. 7 shows the details of the funnel (3) connection to the rigid main framework (1) where a pivot pin (10) connects the two brackets (11) mounted on the loop section (20) of the rigid main framework (1) through the pivot tube (8) that is an integral part of the funnel (3) by way of the brackets (9) such that the pivot tube (8) may pivot about the pivot pin (10) to allow the funnel to be moved, typically raised, relative to the rigid main framework to allow access for attachment and removal of the sandbags to & from the hooks.

A stop (12) fixed to the pivot tube (8) acts on a cross bar (13) such that the funnel (3) can only be lowered to a determined position suitable for directing material through the funnel into the receptacle supported on the hooks. The position of the stop (12) between the brackets (9) and behind the main framework (1) and the cross bar (13) ensures that articles such as fingers or items of clothing, are unlikely to get trapped as the funnel (3) is lowered.

FIG. 8 shows details of the connection between the swinging arm bracket (5) and the rigid main framework (1) where the bracket (5) is allowed to pivot about a pivot pin (6) that is acting on a bracket (22) connected to a cross member (19) of the rigid main framework (1) such that a spring (7) in tension and connected between the rigid main framework (1) and the swinging arm bracket (5) forces the swinging arm bracket to rotate about the pivot pin (6) until the stop (21) incorporated into the bracket (5) comes into contact with the cross member (19) to allow the swinging arms to reach a pre-determined position relative to the rigid main framework.

The position of the spring (7) within the main framework (1) and the location of the stop (21) to engage with the underside of the cross member (19), at the bottom of the main framework when in use, substantially reduces the chances of articles such as fingers or items of clothing will be trapped or damaged as the swinging arm mechanism is employed.

What is claimed is:

1. A bag holder, where the neck of the bag, sack or sandbag is held open by hooks, with a funnel of conical shape with an enclosed angle of approximately 80° positioned over the neck of the sandbag to guide material into the bag consisting of a main framework and the pivoting framework to support hooks to engage the bag, sack or sandbag with an elastic device acting between the main framework and the pivoting framework to provide tension to engage the bag and where the main framework includes a main structural element bent to provide a handle fro transporting the device.

2. A bag holding and filling device, where the neck of the bag, sack or sandbag is held open by hooks with a funnel of conical shape with an enclosed angle of approximately 80° positioned over the neck of the bag, sack or sandbag to guide material into the bag, sack or sandbag, consisting of a main framework and a pivoting framework with an elastic device acting between the main framework and the pivoting framework to provide tension to engage the bag, sack or sandbag where the main framework is of tubular structure and includes a main structural element bent to provide a handle for transporting the device and to provide a location for the pivot point for the funnel.

3. A bag holding and filling device as claimed in claim 2 where the framework includes features that allow for dismantling and reassembling for transport and storage.

4. A bag holding and filling device as claimed in claim 3 where there are a spring and a stopper provided to active and constrain movement of the pivoting framework, the spring and stopper being positioned within the layout of the main and pivoting frameworks so as to reduce the likelihood of body parts, articles of clothing or other items from becoming trapped by the pivoting action of the pivoting framework.

5. A bag holding and filling device as claimed in claim 4 where the funnel can be removed from its pivoting location and re fixed to the main framework in such a way as to engage the pivoting arms against the tension providing mechanism.

6. A bag holding and filling device as claimed in claim 5 with detachable feet supports that can be reengaged with the main framework for storage and assembly.

7. A bag holding and filling device as claimed in claim 6 in which reduced diameter sections of the feet supports incorporate a hole can be aligned with a hole in the main framework to allow engagement between the feet and the main framework.

* * * * *